US008857972B2

(12) United States Patent
Toyoshima

(10) Patent No.: US 8,857,972 B2
(45) Date of Patent: Oct. 14, 2014

(54) INKJET RECORDING APPARATUS

(75) Inventor: Shinji Toyoshima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 12/986,037

(22) Filed: Jan. 6, 2011

(65) Prior Publication Data

US 2011/0102532 A1 May 5, 2011

Related U.S. Application Data

(63) Continuation of application No. 11/761,979, filed on Jun. 12, 2007, now Pat. No. 7,887,179.

(30) Foreign Application Priority Data

Jun. 15, 2006 (JP) ..... 2006-166202

(51) Int. Cl.

| | |
|---|---|
| ***B41J 2/165*** | (2006.01) |
| ***B41J 2/01*** | (2006.01) |
| ***B41J 11/00*** | (2006.01) |
| ***B41J 11/06*** | (2006.01) |
| ***B41J 13/00*** | (2006.01) |

(52) U.S. Cl.

CPC ..... *B41J 11/06* (2013.01); *B41J 11/0085* (2013.01); *B41J 11/0025* (2013.01); *B41J 13/0054* (2013.01); *B41J 11/0065* (2013.01)

USPC ..... 347/104; 347/20; 347/22; 347/36; 347/101

(58) Field of Classification Search

USPC ..... 347/36, 101, 104

See application file for complete search history.

(56) References Cited

U.S. PATENT DOCUMENTS

| | | | | |
|---|---|---|---|---|
| 6,517,179 | B2 * | 2/2003 | Hinojosa et al. | 347/16 |
| 2003/0085980 | A1 * | 5/2003 | Ishii et al. | 347/104 |

FOREIGN PATENT DOCUMENTS

| | | | |
|---|---|---|---|
| JP | 2003-246524 | A | 9/2003 |
| JP | 2003-266837 | A | 9/2003 |
| JP | 2003-285479 | A | 10/2003 |
| JP | 2004-358944 | A | 12/2004 |

* cited by examiner

*Primary Examiner* — Ryan Lepisto

(74) *Attorney, Agent, or Firm* — Canon U.S.A., Inc. IP Division

(57) ABSTRACT

An inkjet recording apparatus includes a platen holding a recording medium at a position opposed to a recording head, a suction generating member for suctioning the recording medium to the platen, a first recessed portion provided at a region on the platen and connected with the suction generating member, where the region faces a scanning area of the recording head, and a second recessed portion provided at a position on the platen and connected with the suction generating member, where the second recessed portion is provided on the downstream side of a region opposed to the scanning area and provided at a position corresponding to an end portion of the recording medium to be conveyed.

11 Claims, 11 Drawing Sheets

INKJET RECORDING APPARATUS

CROSS-REFERENCE TO RELATED APPLICATIONS

This application is a continuation of U.S. application Ser. No. 11/761,979 filed Jun. 12, 2007, which claims priority from Japanese Patent Application No. 2006-166202 filed Jun. 15, 2006. In addition, U.S. application Ser. No. 11/761,979, Japanese Patent Application No. 2006-166202, and Japanese Patent Application No. 2005-257881 filed Sep. 6, 2005 are hereby incorporated by reference herein in their entirety.

BACKGROUND OF THE INVENTION

1. Field of the Invention

The present invention relates to an inkjet recording apparatus for discharging ink from a recording head to record an image on a recording medium, and more particularly, an inkjet recording apparatus including a suction generating member for suctioning a recording medium to a platen.

2. Description of the Related Art

In a printer, a copying machine, a facsimile, a scanner, or a composite machine or system of those, a recording apparatus for forming an image on a recording medium, e.g. a recording paper, based on image information is used. As one embodiment of the recording apparatus, an inkjet recording apparatus which discharges ink to a recording medium from a discharge port of the recording head is widely used. "An image" in the present specification includes letters and symbols.

In order to perform stable recording, an inkjet recording apparatus needs to eliminate an influence of creases or wavy deformation (cockling) generated at the time when ink is fixed to a recording medium, as much as possible. Therefore, various methods to keep a space between the surface of the recording medium and a recording head constant have been proposed. Further, in consideration of the case when a recording medium originally curled due to humidity and the like is used, a method for preventing paper from floating toward the recording head from a platen in an image forming unit has also been proposed. That is, when the recording medium floats, the floating portion is contacted and rubbed by a recording head, a carriage or a surrounding guide mechanism, and thus a recording surface is damaged or smudged, which causes the reduction of an image quality. Further, the surface of discharge ports of the recording head (the surface on which discharge ports are arrayed) can be damaged by contacting the floating portion.

Accordingly, a configuration is proposed in which a suction portion for suctioning a recording medium to a platen is provided at the platen opposed to a recording head to suppress curling and cockling of the recording medium. Japanese Patent Application Laid-Open No. 2002-178542 discusses an apparatus using such a suction platen. The discussed apparatus includes many suction holes on a recording medium supporting surface of the hollowed platen and generates a negative pressure inside the platen using a suction generating member, e.g. a fan, to suction the recording medium to the platen.

Further, a configuration is known in which, when the inkjet recording apparatus performs a borderless recording (a marginless recording) which records an image up to an edge without providing margins, an image is recorded on a roll recording medium. Japanese Patent Application Laid-Open No. 11-321016 discusses an apparatus which records an image up to the outside region including the edge in the width direction of the recording medium and automatically cuts the recording medium having a recorded image in the conveyance direction by a cutter.

In this case, an ink receiver which is conventionally provided at a corresponding position on the platen is used to receive an ink discharged outward in the width direction of the recording medium. The ink receiver is recessed and has an opening on a conveyance supporting surface. Further, the ink receiver includes an ink absorbing material inside thereof. The ink receiver also includes a hole formed in the inside, from which the received ink is guided to a waste ink storage portion.

However, conventional inkjet recording apparatuses have the following problems. As the recording medium, paper or a film can be used, whose end portions are easily upwardly warped or curled depending on temperature and humidity environment. Thus, when such a recording medium is used, the available temperature and humidity environment is limited. That is, if the inkjet apparatus performs recording in an environment beyond the limitation of the temperature and humidity, an edge portion on a downstream side of the recording medium which is conveyed from a suction region of the platen, is upwardly warped up to where a fixed amount of the recording medium is conveyed. Thus, the recording medium is rubbed by contacting a recording head or a carriage so that an image quality is reduced.

A section up to where the fixed conveyance amount is conveyed, is the section up to where the edge portion of the recording medium is physically prevented from upwardly warping, or the edge portion of the recording medium hangs down under its own weight, which depends on a type of the recording medium. That is, the recording medium is conveyed with the upwardly warping edge portion until reaching the above point. As for a method for physically suppressing the upwardly warping, for example, a guide member in a conveying path is used, and a dustcover roller 32 provided at a dust cover 31 is used in an inkjet recording apparatus according to the embodiment of the present invention described below. Further, upwardly warping of the edge portion of the recording medium on the platen is reduced after passing this section, and thus the edge portion of the recording medium is not contacted and rubbed by the recording head or carriage.

In addition, high viscosity ink is used in order to maintain a high quality image in high speed recording, however, there are problems with respect to the high viscosity ink. In recent years, since a higher recording speed and a higher quality image are required, a high viscosity ink are more often used. When the high viscosity ink is used for recording, a preliminary discharge is generally performed before recording the image on the recording medium. In the preliminary discharge, ink is discharged not for the purpose of recording. When the viscosity of an ink in the discharge port of the recording head increases (viscosity increase) due to evaporation of a solvent, ink discharge from the recording head becomes unstable at the time of recording, and thus a recording image quality is reduced. The higher the viscosity of the ink, the more unstable the ink discharge becomes. Thus, when the high viscosity ink is used, the preliminary discharge is more frequently performed.

Further, all of discharge ports (nozzles) does not necessarily discharge the ink during a recording process depending on recording data. Moreover, a specific nozzle may not be used at all for a fixed period of time. Also, in the case of such nozzles, water contained in ink in the nozzle is evaporated so that the ink viscosity increases. Accordingly, when a discharge pulse is applied to a driving element of such nozzles at the time of recording, the ink can not be sufficiently discharged. Thus, the preliminary discharge has to be performed to prevent such a problem.

In the conventional inkjet recording apparatus, an ink receiver (a preliminary discharge receiver) that receives ink discharged by preliminary discharging is provided out of a recording region, that is, out of a paper passage region of a recording medium having a maximum size (a maximum width) which can be used. Therefore, the preliminary discharge before recording an image on a recording medium having a small size (a small width) must be performed each time by moving a recording head more than necessary to the ink receiver, which is separated from the recording medium more than needed. Thus, when an image is recorded on the recording medium having a small size, the recording head (the carriage) must be moved for the same distance as that for the medium having a maximum size, for every preliminary discharge. Therefore, the same time as that for the recording medium having a maximum size is required for a process of recording one sheet of the small size, so that the through put of the recording is reduced.

SUMMARY OF THE INVENTION

The present invention is directed to an inkjet recording apparatus capable of suppressing contact of a recording medium with a recording head or a carriage owing to upwardly warping of an edge portion of the recording medium from the platen when the recording medium is conveyed.

According to an aspect of the present invention, an inkjet recording apparatus includes a platen holding a recording medium at a position opposed to a recording head, a suction generating member configured to suction the recording medium to the platen, a first recessed portion provided at a region of the platen opposed to the scanning area of the recording head and connected to the suction generating member, and a second recessed portion provided at a position corresponding to an end portion of the recording medium to be conveyed, which is provided on the downstream side from the region of the platen opposed to the scanning area of the recording head and is connected to the suction generating member.

When a recording medium having an upwardly warped edge portion is conveyed, contact of the recording medium with a recording head or a carriage owing to upward warping of the edge portion of the recording medium can be suppressed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
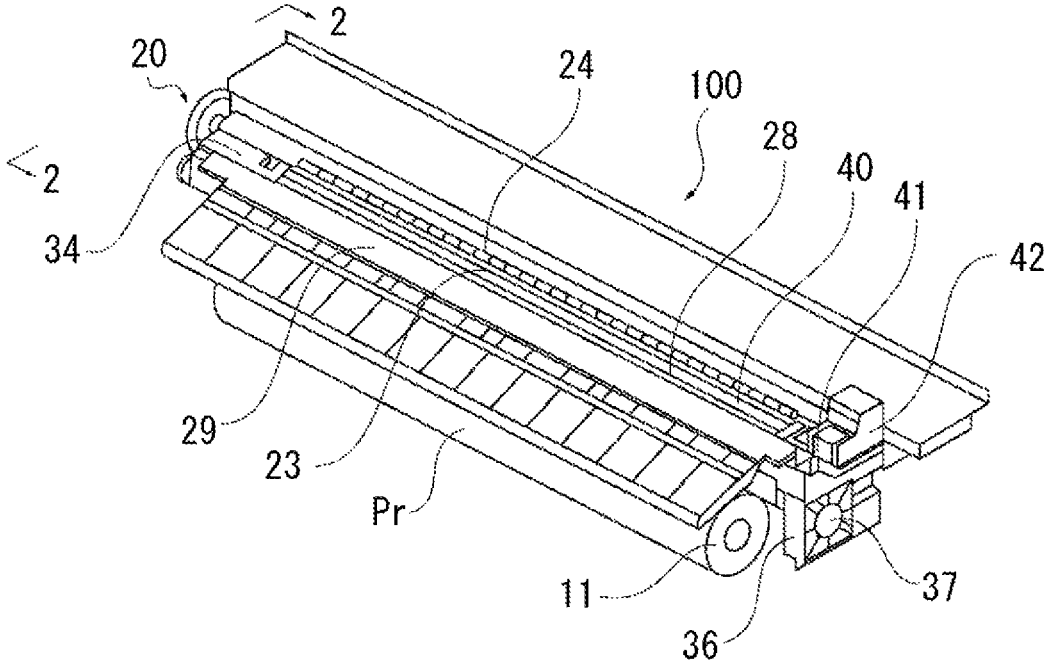
FIG. 1 is a perspective view illustrating an inside of an inkjet recording apparatus according to one embodiment of the present invention.
Figure 2:
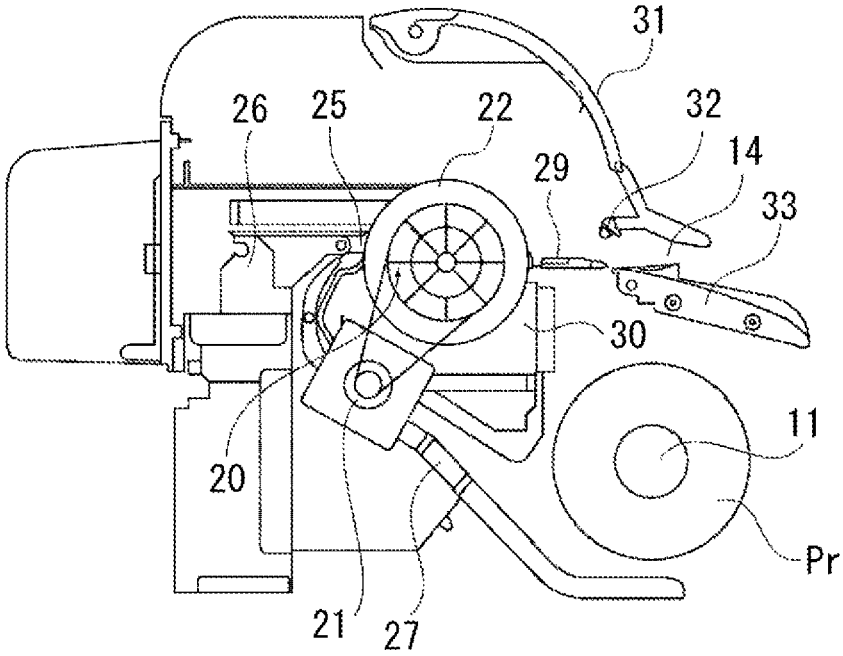
FIG. 2 is a left side view of the inkjet recording apparatus in FIG. 1 seen in a direction of an arrow 2-2 in FIG. 1.
Figure 3:
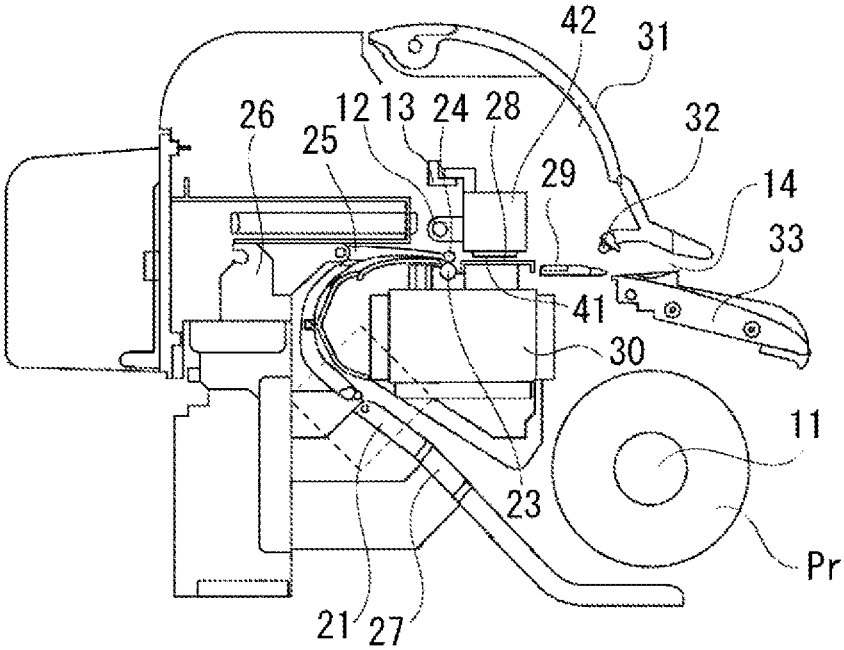
FIG. 3 is a longitudinal cross sectional view of a central portion of the inkjet recording apparatus in FIG. 1.

FIG. 1 is a perspective view illustrating an inside of an inkjet recording apparatus according to one embodiment of the present invention. FIG. 2 is a left side view of the inkjet recording apparatus in FIG. 1 seen in a direction of an arrow 2-2 in FIG. 1. FIG. 3 is a longitudinal cross sectional view of a central portion of the inkjet recording apparatus in FIG. 1. In FIGS. 1 to 3, an inkjet recording apparatus 100 according to the present embodiment uses a long paper roll Pr wound in a roll as a recording medium, and the paper roll Pr is mounted unwindable on a rotatable spool 11.

The recording medium Pr that is to be unwound is held between a conveyance roller 23 and a pinch roller 24. The recording medium Pr is fed along a paper feeding guide 27 and conveyed through the inside of an apparatus body driven by the rotation of the conveyance roller 23. Inside the apparatus body, a conveyance mechanism 20 is provided which performs feeding, conveying, and discharging of the recording medium. On the downstream side in the conveyance direction of the conveyance roller 23, an image recording section 40 is provided which records an image on the recording medium supported on a platen 28 by a recording head 41. The recording medium having a recorded image is cut to a predetermined length by an automatic cutter (not illustrated) while being conveyed along an upper surface of a paper discharge guide 29 and a roll paper cover 33. The automatic cutter is adjacently provided on a downstream side in the conveyance direction of the platen 28. The recording medium (a cut paper) thus cut is discharged out of the apparatus body.

In FIGS. 2 and 3, a conveyance motor 21 drives the conveyance roller 23, and a conveyance pulley 22 fixed at a shaft of the conveyance roller 23 transmits driving force of the conveyance motor 21 to the conveyance roller 23. A pinch roller arm 25 rotatably supports the pinch roller 24, and a pinch roller holder 26 elastically supports the pinch roller arm 25 to enable pressing the pinch roller 24 to contact with the conveyance roller 23. In FIG. 1, the inkjet recording apparatus according to the present embodiment includes a preliminary discharge receiving platen 34 at positions (both sides) out of a recording region of the platen 28. This preliminary discharge receiving platen 34 receives ink discharged from a recording head 41 in preliminary discharge described below.

A recording head 41 is mounted on a carriage 42 capable of reciprocating in a main-scanning direction (the width direction of the recording medium) along the recording medium. The carriage 42 is slidably guided and supported along a guide shaft 12 and a guide rail 13, which are provided in the apparatus body. The ink jet recording head 41 discharges ink based on image information to record an image on the recording medium. The recording head includes a discharge port array (a nozzle array) at a discharge port surface opposed to the recording medium, and the discharge port array includes a plurality of discharge ports in a predetermined array. Each discharge port constituting the discharge port array is selectively driven based on the image information to discharge the ink to form a desired image.

The platen 28 guides and supports the recording medium to form a predetermined space between the recording head 41 and the recording medium Pr in an image forming unit. The platen 28 in this embodiment includes a suction platen capable of suctioning the recording medium to a guiding and supporting surface of the platen. The suction platen 28 is supported by an upper surface of a hollow casing 30. On the recording medium supporting surface of the suction platen 28, a plurality of suction grooves 38 (refer to FIG. 4) is provided. These suction grooves 38 are connected to a suction generating member (a negative pressure generating member) through the inside of the casing 30. The casing 30 extends over the range corresponding to the platen 28 in the width direction of the apparatus body. The suction generating member in this embodiment includes a suction fan unit 36 having a suction fan 37 mounted on an end portion (right side end in FIG. 1) of the casing 30.

A dust cover 31 is mounted openable and closable on the downstream side above the end portion in the conveyance direction of a paper discharge guide 29. A guide roller 32 is provided at an inner surface of the dust cover 31. The guide roller 32 is provided for guiding the recording medium toward a paper discharge port 14. The guide roller 32 suppresses upward warping of an edge portion of the recording medium on the downstream side which is conveyed from the suction region of the platen 28. By suppressing the upward warping, the recording medium can be prevented from contacting and rubbing the recording head 41 or the carriage 42. That is, the guide roller 32 is a member which realizes a section of the fixed conveyance amount in which the upward warping of the edge of the recording medium is physically suppressed in a case where the recording is performed beyond the limitation range of the temperature and humidity environment.

Figure 4:
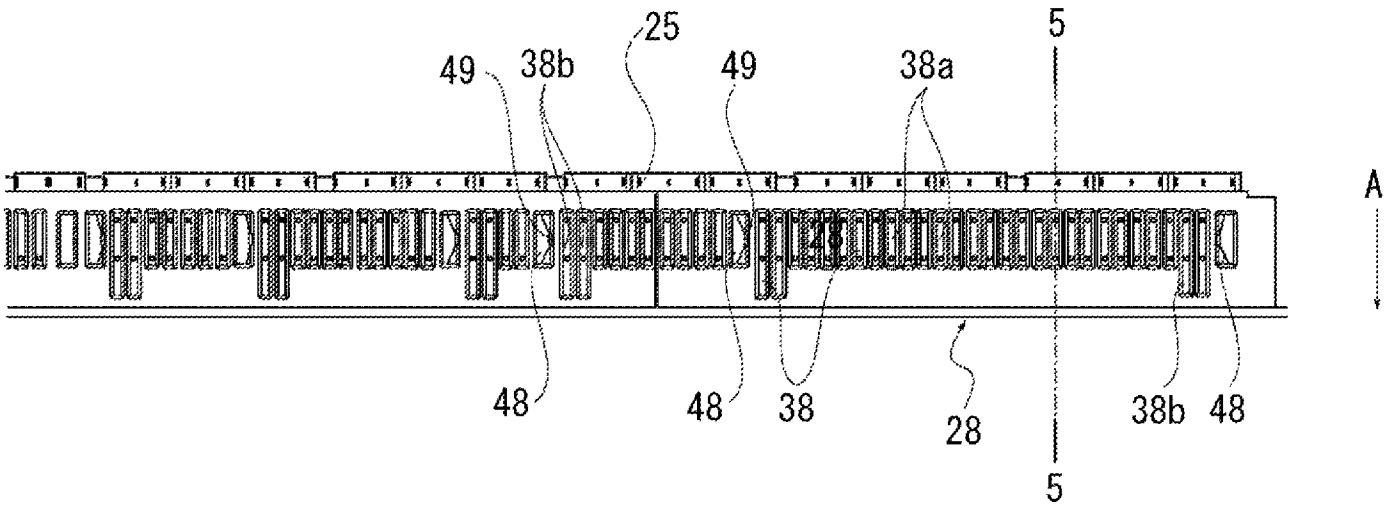
FIG. 4 is a plane view illustrating a platen of an inkjet recording apparatus according to one embodiment of the present invention.
Figure 5:
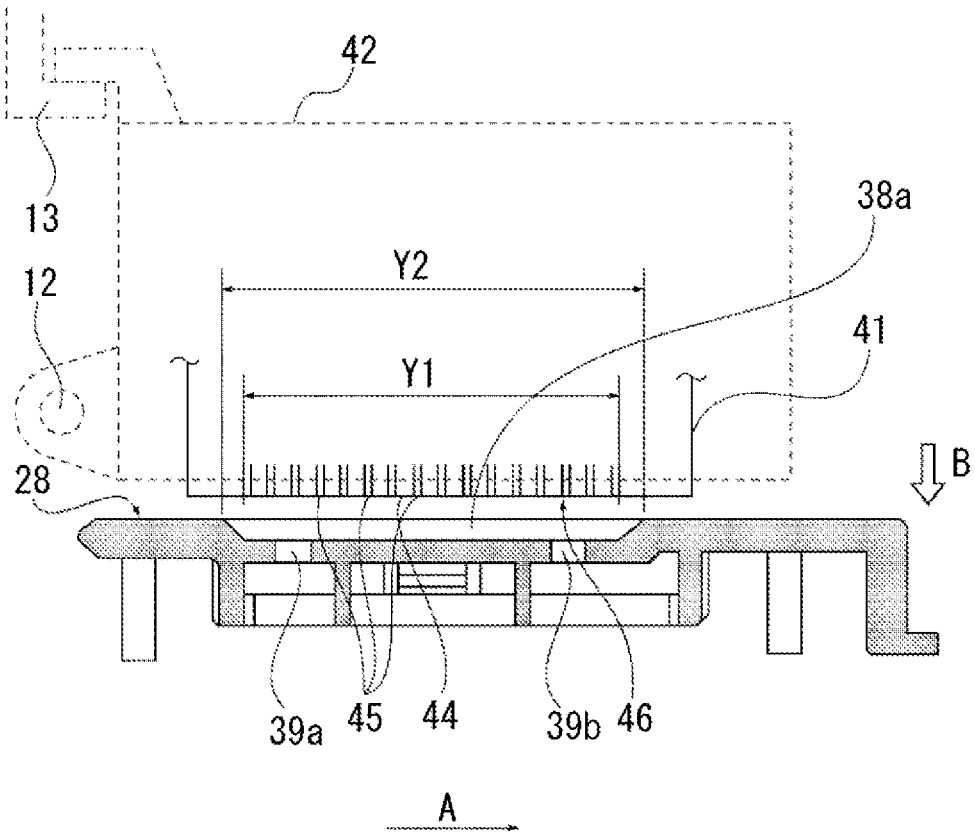
FIG. 5 is a longitudinal cross sectional view in the length direction of a suction groove of suction grooves provided on the platen in FIG. 4 which has a regular length in the conveyance direction.
Figure 6:
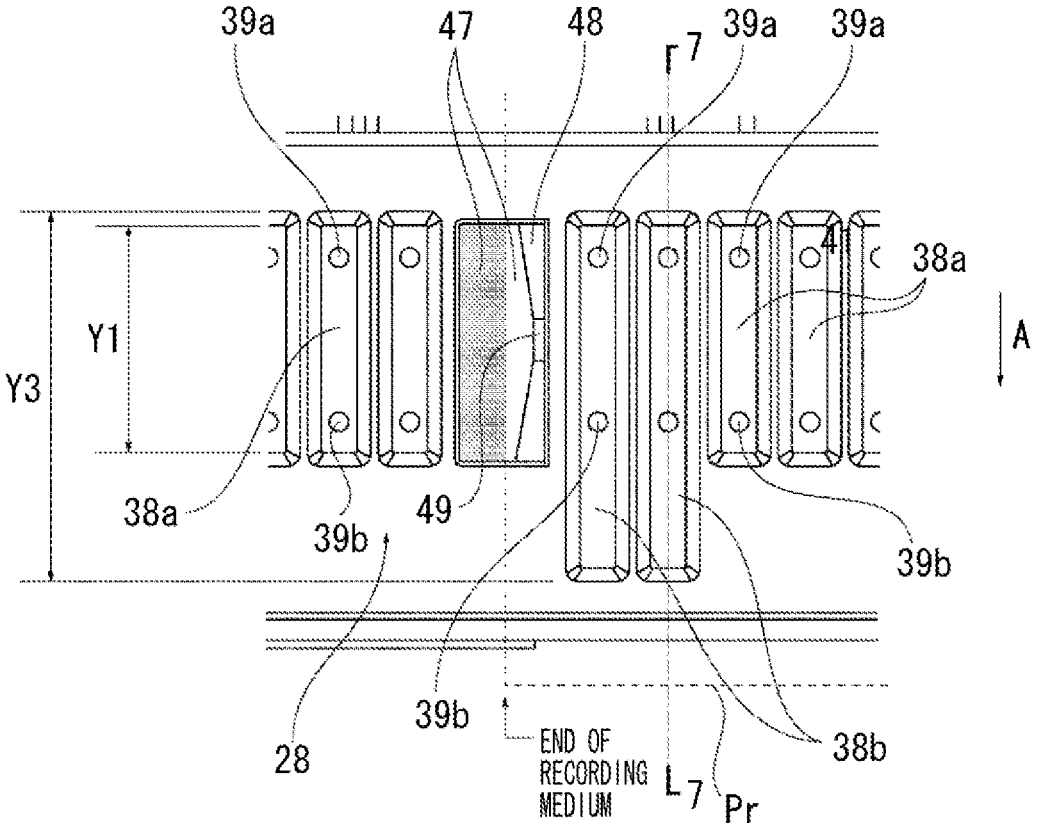
FIG. 6 is partial plane view illustrating a suction groove and an ink receiver formed at a position corresponding to an end portion in the width direction of a recording medium to be used on the platen in FIG. 4.
Figure 7:
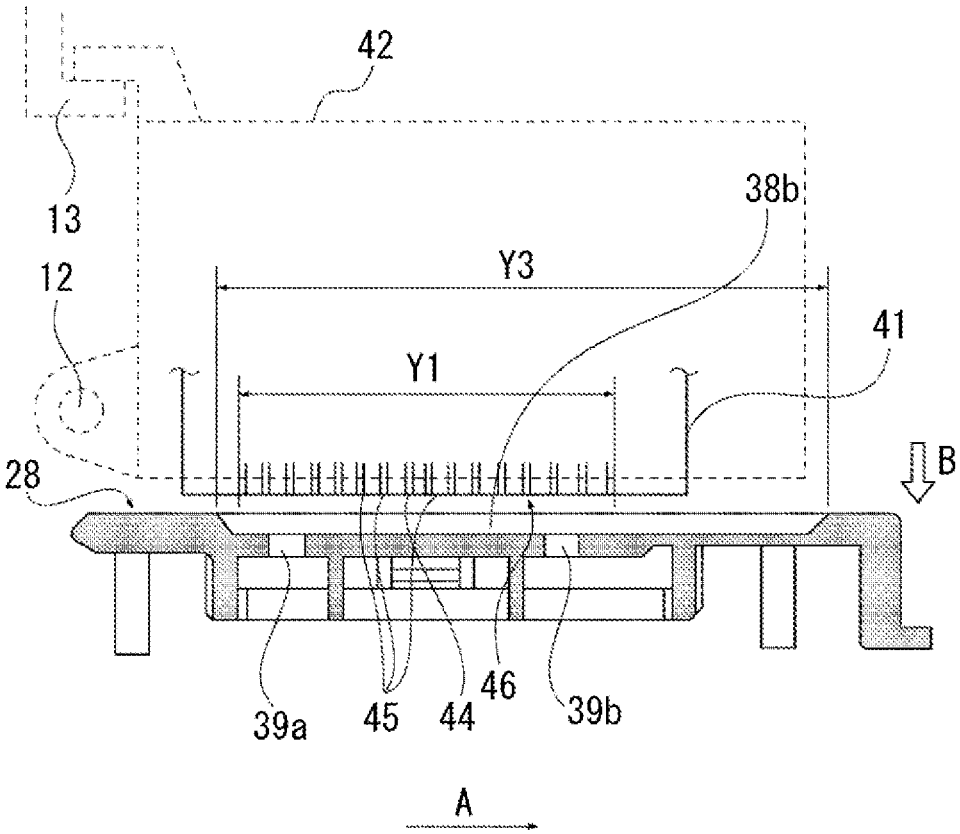
FIG. 7 is a longitudinal cross sectional view of a suction groove in a conveyance direction formed extending to the downstream side in the conveyance direction more than a discharge port array of a recording head in a region corresponding to an end portion in the width direction of a recording medium to be used on the platen in FIG. 4.

FIG. 4 is a plane view illustrating a platen 28 of an inkjet recording apparatus according to one embodiment of the present invention. FIG. 5 is a longitudinal cross sectional view in the length direction of a suction groove of suction groove 38 provided on the platen 28 in FIG. 4 which has a regular length in the conveyance direction. FIG. 6 is a partial plane view illustrating a suction groove 38 and an ink receiver 48 formed at a position corresponding to an end portion in the width direction of a recording medium to be used on the platen 28 in FIG. 4. FIG. 7 is a longitudinal cross sectional view of a suction groove 38*b* in a conveyance direction formed extending to the downstream side in the conveyance direction from a discharge port array of a recording head in a region corresponding to an end portion in a width direction of a recording medium to be used on the platen 28 in FIG. 4. In FIGS. 4 to 7, a plurality of suction grooves 38 is formed at a predetermined interval in the width direction (the main-scanning direction, i.e., the moving direction of the carriage 42) of the recording medium on the suction platen 28 which holds a rear surface of the recording medium. On the other hand, at a discharge port surface 44 of the recording head 41, a discharge port array 46 is provided. The discharge port array 46 includes a plurality of discharge ports 45 provided at an interval of predetermined pitch in the conveyance direction (a sub-scanning direction) of the recording medium.

An arrow A in FIGS. 4 to 7 indicates the conveyance direction (the sub-scanning direction) of the recording medium. As illustrated in FIG. 4, a plurality of suction grooves 38 (many suction grooves 38 are shown in FIG. 4) is formed at an interval of a predetermined pitch in the moving direction of the carriage 42 on the platen 28. As illustrated in FIG. 5, regular suction grooves 38*a* (a first recessed portion) of the grooves 38 are formed within the approximately similar length at a position corresponding to the discharge port array 46 of the recording head in the conveyance direction. In an example illustrated in FIG. 5, a length Y2 of the regular suction groove 38*a* is slightly longer than a length Y1 of the discharge port array 46. That is, the suction grooves 38*a* are provided at a position corresponding to the recordable region Y1 of the recording head in the conveyance direction of the recording medium.

Further, corresponding to the size of the recording medium Pr to be used (for example, a lateral width size of A4 size or B3 size), suction grooves 38*b* (a second recessed portion) of the suction grooves 38 are positioned near the inner side of the end portion in the width direction of the recording medium. The suction grooves 38*b* are formed extending on the downstream side in the conveyance direction from the regular suction grooves 38*a*. That is, while the end portion on the upstream side in the conveyance direction of the longer suction grooves 38*b* are the same as the regular suction grooves 38*a*, the suction groove 38*b* on the downstream side in the conveyance direction is more projected to the downstream side in the conveyance direction than the suction grooves 38*a*. Therefore, as illustrated in FIGS. 6 and 7, a length Y3 of the extending suction groove 38*b* is fully longer (for example, about 1.3 times to 2.0 times) than the length Y1 of the discharge port array 46. That is, the suction grooves 38*b* are provided at a position occupying a region on the downstream side of the recordable region Y1 of the recording head in the conveyance direction of the recording medium.

In the present embodiment, as illustrated in FIG. 6, two suction grooves provided on the region for suctioning the end portion in the width direction of the recording medium Pr having each size to be used, are the extending suction grooves 38*b* having the length Y3. The other suction grooves are the regular suction grooves 38*a* having the length Y2 approximately similar to that of the discharge port array 46. As illustrated in FIG. 7, the end portion on the downstream side in the conveyance direction of the suction groove 38*b* having the length Y3 is more projected on the downstream side than the end portion on the downstream side of the carriage 42. The suction grooves 38*b* are provided in plural places corresponding to a type of the recording medium size to be used. Further, the bottom surfaces of the suction grooves 38 (38*a*, 38*b*) include suction holes 39*a* and 39*b* provided at two positions separated at a predetermined interval in the conveyance direction.

In FIGS. 4 and 6, an ink receiver 48 for receiving ink discharged from the recording head 41 is formed at the region which includes an edge of the recording medium and lies off the edge corresponding to the size of the recording medium to be used on the platen 28. The ink receiver 48 receives ink impacted on the outside of the edge of the recording medium when borderless recording (a marginless recording) is performed to the recording medium Pr. For this objective, the ink receiver 48 is provided at each region corresponding to the edge portions on the both sides of the recording medium.

Further, the ink receiver 48 receives discharged ink at the time of a preliminary discharge (ink discharge not for the purpose of recording), which is performed to refresh ink in the discharge port, depending on the size of the recording medium to be used. For example, when the size of the recording medium is comparatively small, the ink receiver 48 is used for this objective. An opening portion 49 for delivering internal ink is provided on the inner side of the recording medium in each ink receiver 48 (the position on the right side in FIG. 6). The ink receiver 48 is also provided at plural positions corresponding to the size of the recording medium to be used.

An ink impact surface in the ink receiver 48 is formed as a surface 47 which inclines in the moving direction of the carriage 42. The inclining surface 47 inclines in the main-scanning direction from the opposite side so as to be the lowest at the opening portion 49 in the ink receiver 48. In the present embodiment, as illustrated in FIG. 6, the opening portion 49 is provided at an end portion (the end portion on the right side in FIG. 6) on the inner side of the recording medium. Therefore, the inclining surface 47 inclines in a direction going gradually lower from the outer side toward the inner side in the width direction of the recording medium, that is, in the direction parallel to the moving direction of the carriage 42. The suction holes 39*a* and 39*b* on the bottom surface in the suction grooves 38 as well as the opening portion 49 in the ink receiver 48 respectively communicate with the inside of the casing 30 which is in a negative pressure state caused by the suction fan 37.

Therefore, by suction of the negative pressure working in the suction grooves 38 through the suction holes 39*a* and 39*b*, the recording medium can be conveyed while adhering to the supporting surface of the platen 28. Further, the ink discharged into the ink receiver 48 is let out by the suction of the negative pressure working from the opening portion 49 and guided to a predetermined waste ink storage unit. Since the negative pressure also works on the ink receiver 48, the recording medium can be suctioned to the platen 28 also in the region of the ink receiver 48. The ink receiver 48 including the above-described configuration can also be provided in the region where the ink receiver 48 does not interfere with the recording medium having a size to be used, and the ink discharge not for the purpose of recording (a preliminary discharge) is performed. That is, the ink receiver 48 can be provided to realize both or one of functions for receiving overflowing ink at the time of a borderless recording and for receiving the ink discharged in a preliminary discharge.

The recording medium Pr on which an image is formed by the recording head 41 on the platen 28 is cut to have a predetermined length by an automatic cutter (not illustrated) adjacently provided at end portion on the downstream side in the conveyance direction of the platen 28. The recording medium Pr is conveyed and discharged toward the outside of the apparatus body as a cut sheet. In FIG. 7, an arrow B indicates a cutting position of the recording medium.

Figure 8:
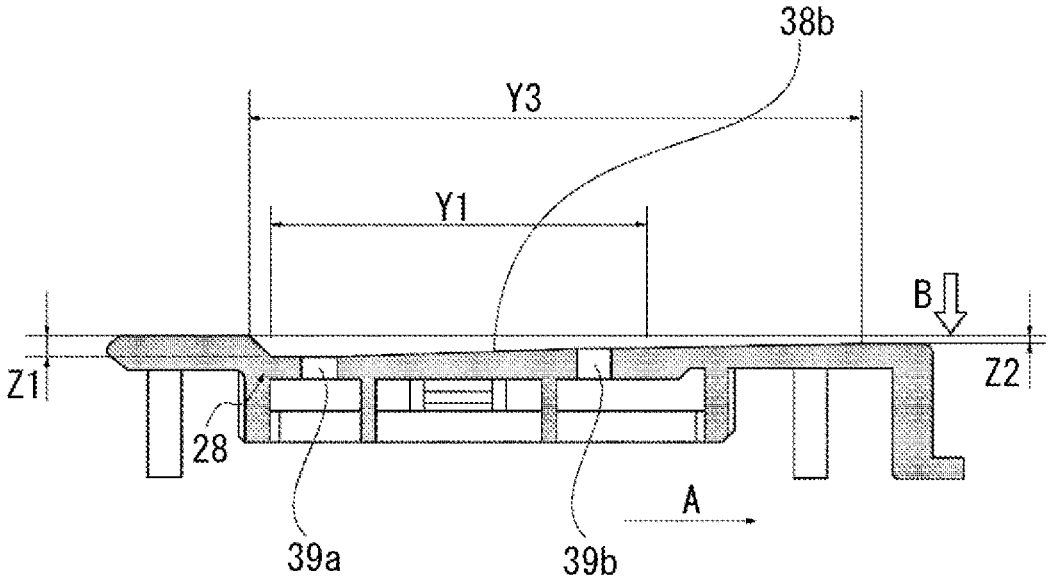
FIG. 8 is a longitudinal cross sectional view in the conveyance direction for illustrating the another example of a suction groove formed extending to the downstream side in the conveyance direction in FIG. 7.

FIG. 8 is a longitudinal cross sectional view in the conveyance direction for illustrating another example of suction grooves 38*b* formed extending to the downstream side in the conveyance direction. Depth of the suction grooves 38*b* in FIG. 8 become gradually shallow to the downstream side in the conveyance direction. That is, the suction grooves 38*b* in FIG. 8 become gradually shallow from the depth Z1 at the end portion on the upstream side in the conveyance direction, which is approximately similar to the suction groove in FIG. 7, to the depth Z2 at the end portion on the downstream side in the conveyance direction (Z1>Z2). Although the suction groove in FIG. 8 is different from the suction groove in FIG. 7 in this point, these grooves have a substantially similar configuration in other points. Therefore, corresponding portions are represented by same symbols, and the detailed descriptions are omitted.

In the above-described embodiment, the platen 28 provided at the position opposed to the recording head 41 includes a plurality of the suction grooves 38 connected to the suction generating member (i.e., the suction fan 37) for suctioning the recording medium to the platen 28. Further, corresponding to the size of the recording medium to be used, the suction grooves 38*b* (the second recessed portion) positioned at the end portion of recording medium extend to the downstream side in the conveyance direction from the discharge port array 46 of the recording head. According to such configuration, when a recording medium such as upwardly warped paper or film is conveyed, the recording medium can be prevented from contacting the recording head 41 or the carriage 42 due to upward warping of the edge portion of the recording medium conveyed from the suction region of the platen. Further, the limitation of the temperature and humidity environment for the recording medium such as upwardly warped paper or film can be loosened or abolished.

Further, according to the above-described embodiment, the ink receiver 48 is provided at the region lying off from the edge of the recording medium corresponding to the size of the recording medium to be used, including an edge of the recoding medium, or the region for performing ink discharge not for the purpose of recording on the platen 28. The ink receiver 48 receives ink discharged from the recording head 41. Further, the ink impact surface of the ink receiver 48 is formed as the inclining surface 47 which inclines in the moving direction of the carriage. Thus, the impacted ink flows along the inclining surface 47 so that an effect of ink washing out can be achieved by the inclining surface 47. Therefore, even when a high viscosity ink is used, adhering or depositing of the ink can be reduced or eliminated. As the effect of ink washing out, the ink is prevented from depositing by flowing low viscosity ink from the upstream side to high viscosity ink so that the inks are mixed with each other.

Further, since the opening portion 49 connected to the negative pressure generating member (the suction fan 37) is provided in the ink receiver 48, the ink discharged toward the outside of the recording medium at the time of borderless recording can be guided to a waste ink storage region, so that adhering of an ink onto the platen 28 can be in a sure manner prevented. In this case, it is more effective when the ink impact surface of the ink receiver 48 is formed as the inclining surface 47 which lowers from the outer side in the width direction of the recording medium toward the inner side thereof. Further, since the negative pressure works on the ink receiver 48, floating of paper on the ink receiver can be prevented like in the case of the suction grooves 38. Furthermore, when a recording medium having a small size is recorded, the above-described preliminary discharge can be performed using the ink receiver 48 for borderless recording. Thus, the recoding time per sheet can be decreased, and the recording speed can be increased with improved through put. The effects are especially remarkable when high viscosity ink is used.

The present invention is applicable regardless of the size of a recording medium to be used (or usable) and thus regardless of a number of positions of a platen corresponding to end portions (including both ends) in the width direction of the recording medium to be used, and the similar effect can be obtained. Further, in the above-described embodiment, a recording medium of roll paper is used and fed as an example. However, the present invention can be applied also to an inkjet recording apparatus using a cut sheet, and the similar effect can be obtained.

Further, the above-described example uses the serial type inkjet recording device that performs recording by the recording head mounted on the carriage moving along the recording medium. The present invention can also be applied to a line type inkjet recording apparatus that performs recording only by a sub-scanning using a recording head for full line recording, and in that case, the similar effect can be obtained. Furthermore, the present invention is applicable regardless of the number and type of a recording head and characters of the ink to be used to obtain the similar effect.

Figure 9:
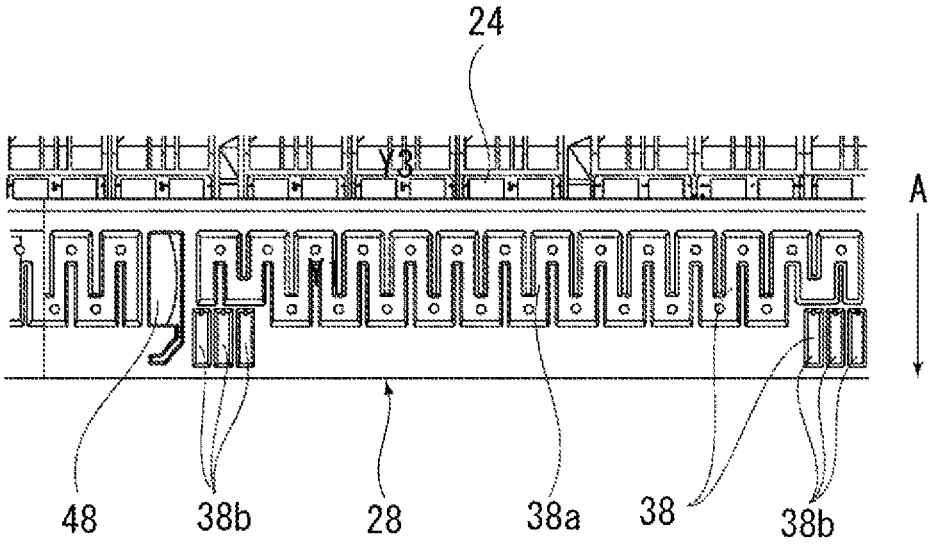
FIG. 9 is a plane view illustrating a platen of an inkjet recording apparatus according to the another embodiment of the present invention.
Figure 10:
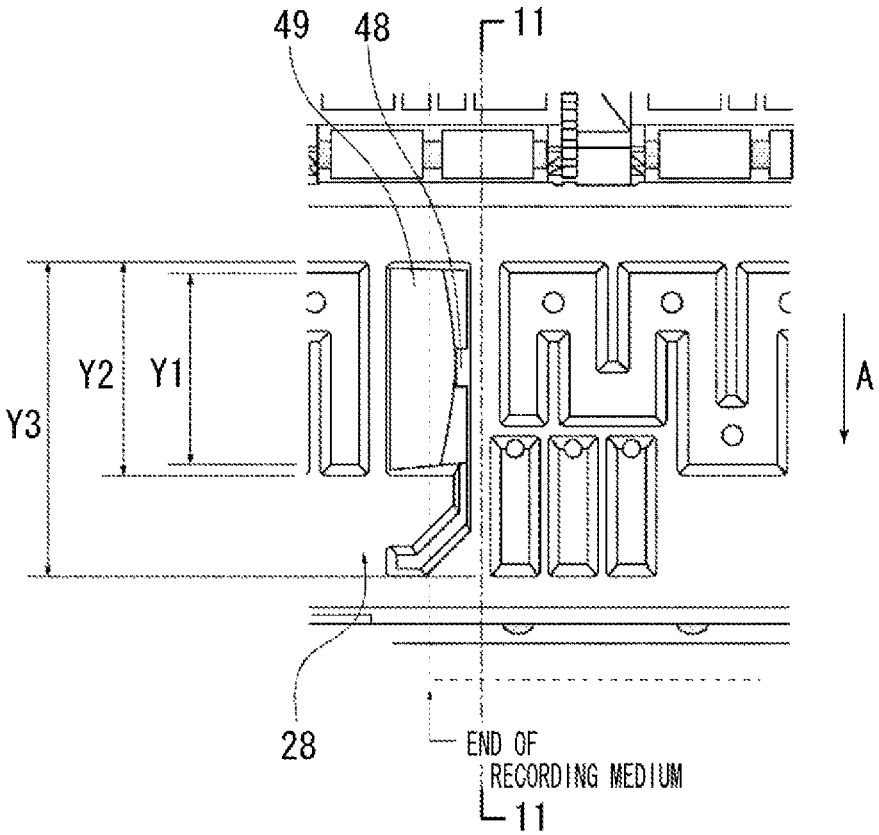
FIG. 10 is a partial plane view of a suction groove formed at a position corresponding to an end portion in the width direction of a recording medium to be used on the platen in FIG. 9.
Figure 11:
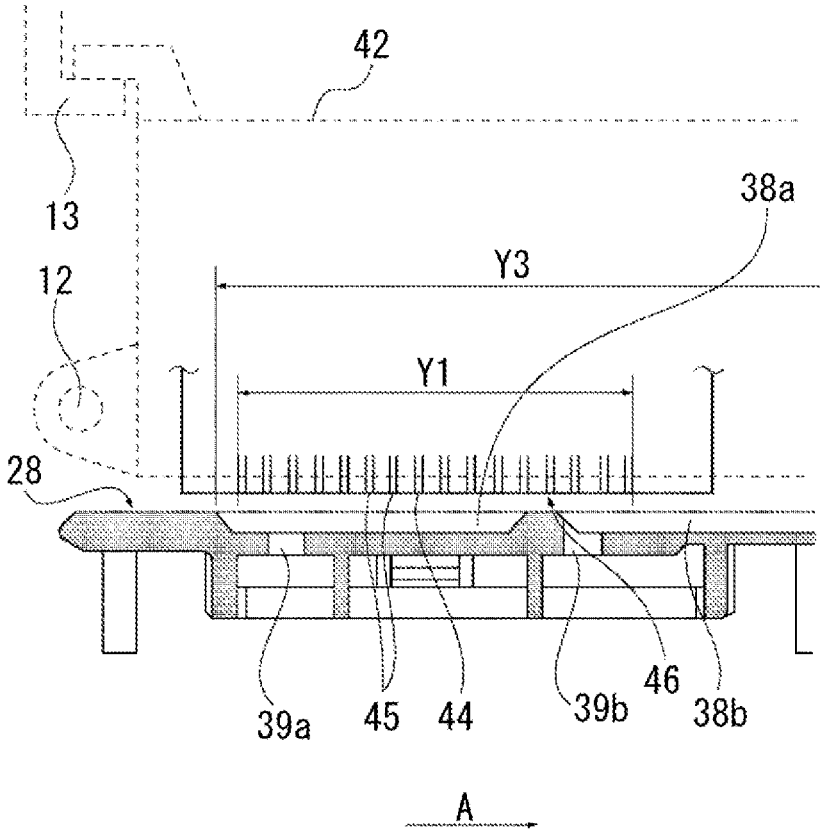
FIG. 11 is a longitudinal cross sectional view in the conveyance direction of a suction groove provided on the downstream side in the conveyance direction from a groove array including a plurality of suction grooves provided on the whole width direction, in a region corresponding to an end portion in the width direction of a recording medium to be used on the platen in FIG. 9.

FIG. 9 is a plane view illustrating the platen 28 of an inkjet recording apparatus according to the other embodiment of the present invention. FIG. 10 is a partial plane view of an ink receiver 48 and a suction groove 38, which are formed at a position corresponding to an end portion in the width direction of a recording medium to be used on the platen 28 in FIG. 9. FIG. 11 is a longitudinal cross sectional view of suction grooves 38*b* in the conveyance direction, which are provided on the downstream side in the conveyance direction from a groove array. The groove array includes a plurality of suction grooves 38*a* provided on a whole area in the width direction corresponding to an end portion in the width direction of a recording medium to be used on the platen 28 in FIG. 9. In FIGS. 9 to 11, the suction groove 38 is formed which is recessed from a recording medium holding surface on the suction platen 28. The platen 28 holds a rear surface of the recording medium. On the other hand, at a discharge port surface 44 of the recording head 41, a discharge port array 46 is provided. The port array 46 includes a plurality of discharge ports 45 provided at an interval of a predetermined pitch in the conveyance direction (the sub-scanning direction) of the recording medium.

An arrow A in FIGS. 9 to 11 indicates the conveyance direction (the sub-scanning direction) of the recording medium.

The suction grooves 38*a* (the first recessed portion) on the whole platen 28 are formed by connecting each groove which extends in the conveyance direction (the sub-scanning direction), in the width direction of the recording medium (the main-scanning direction, i.e., the moving direction of the carriage 42). The suction grooves 38*a* are formed in an approximately similar range of length at a position corresponding to the discharge port array 46 of the recording head in the conveyance direction. In an example illustrated in FIGS. 9 to 11, a length Y2 of the suction groove 38*a* provided on the whole region in the width direction is slightly longer than a length Y1 of the discharge port array 46. That is, the suction grooves 38*a* are provided at a position corresponding to the recordable region Y1 of the recording head in the conveyance direction of the recording medium.

By connecting these suction grooves 38*a* in the width direction (the main-scanning direction, i.e., the moving direction of the carriage 42) of the recording medium, the non-uniformity in image can be reduced. For example, as illustrated in FIG. 4, when a plurality of the grooves extending in the conveyance direction (the sub-scanning direction) is provided in the width direction of the recording medium, non-uniformity in printing may occur between the portions at which the recording medium Pr contacts the platen 28, and the recording medium Pr does not contact the platen 28, depending on the kind of the recording medium. The reason for this phenomenon is considered as follows. In the inkjet recording apparatus including the suction platen, there is a difference in the drying time of ink between the portions at which the recording medium Pr always contacts the platen 28 and the recording medium Pr does not contact the platen 28. Further, as another reason, this phenomenon may occur due to static electricity caused by rubbing when the recording medium Pr is conveyed in contact with the platen 28. In this embodiment, the suction grooves 38*a* are connected in the width direction (the main-scanning direction, i.e., the moving direction of the carriage 42) as illustrated in FIG. 9, to reduce a contacting area between the platen 28 and the recording medium Pr. Thus, the non-uniformity in printing caused by the platen shape can be reduced.

Corresponding to the size of the recording medium Pr (for example, a lateral width size of A4 size or B3 size), the suction grooves 38*b* (the second recessed portion) of the suction grooves 38 are positioned on the inner side of the recording medium at the end portion in the width direction of the recording medium. The suction grooves 38*b* (the second recessed portion) are projected to the downstream side in the conveyance direction from the suction grooves 38*a*, and are isolated from the suction grooves 38*a*. Therefore, as illustrated in FIGS. 10 and 11, a length Y3 at the end most portion on the downstream side in the conveyance direction from the suction grooves 38*b* positioned at the end portion in the width direction of the recording medium, is fully longer (for example, about 1.3 times to 2.0 times) than the length Y1 of the discharge port array 46. That is, the suction grooves 38*b* are provided at a position occupying a region on the downstream side of the recordable region Y1 of the recording head in the conveyance direction of the recording medium.

In the case of forming the continuous suction grooves 38*a* on the suction platen 28 as illustrated in FIGS. 9 and 10, if the suction grooves 38*b* projected to the downstream side in the conveyance direction are integrally formed with the suction grooves 38*a*, the negative pressure runs away from the suction grooves 38*b* at the time of starting recording. Accordingly, the suction grooves 38*b* are isolated from the suction grooves 38*a* so that the negative pressure working on the end portion of the recording medium can not be greatly lost.

In this embodiment, as illustrated in FIG. 10, the isolated three suction grooves 38*b* are provided in the region for suctioning the end portion in the width direction of the recording medium Pr of each size to be used. In this configuration, the end portion on the downstream side in the conveyance direction is positioned at Y3. The other suction grooves are the regular suction grooves 38*a* having the length Y2 approximately similar to that of the discharge port array 46. The end portions of the three suction grooves 38*b* on the downstream side in the conveyance direction, which are isolated and positioned at the end portion in the width direction of the recording medium, is projected to the downstream side further from the end portion on the downstream side of the carriage 42. The suction grooves 38*b* are provided at a plurality of regions corresponding to a type of the recording medium size to be used. The bottom faces of the suction grooves 38*a* of the suction grooves 38 include suction holes 39*a* at a predetermined interval and the bottom faces of the suction grooves 38*b* include suction holes 39*b* at each groove. Furthermore, the suction grooves 38*b* can be formed such that the depth becomes gradually shallow as it goes to the conveyance downstream side.

In this embodiment, the suction grooves 38*a* are connected with each other in the width direction (the main scanning direction, i.e., the moving direction of the carriage 42) of the recording medium, and thus a contacting area between the platen 28 and the recording medium Pr can be decreased, so that un-uniformity owing to the platen can be reduced. Furthermore, since the suction grooves 38*b* positioned on the inner side of the recording medium at the end portion in the width direction of the recording medium is projected to the downstream side in the conveyance direction from the suction grooves 38*a*, the negative pressure of the suction grooves 38*a* can be prevented from running away from the suction grooves 38*b*.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An inkjet recording apparatus comprising:

a platen for supporting a recording medium at a position opposed to a recording head;

a suction generating unit configured to provide suction that holds the recording medium to the platen;

a first recessed portion provided on the platen; and a second recessed portion provided on the platen, wherein the first recessed portion and the second recessed portion are connected to the suction generating unit, wherein the first recessed portion has a first portion that is provided at a position that extends across and entirely occupies a recordable region of the recording head in a conveyance direction of the recording medium, and has a second portion that does not face the recording head, wherein the second recessed portion is provided at a position entirely occupying the recordable region of the recording head in the conveyance direction of the recording medium, and the second recessed portion does not have a portion that does not face the recording head.

2. The inkjet recording apparatus according to claim 1, wherein the second portion is disposed downstream to the first portion beyond a downstream boundary.

3. The inkjet recording apparatus according to claim 1, wherein the first recessed portion occupies both of a part of the region opposed to a scanning area of the recording head on the platen and of a region on a downstream side in a recording medium conveyance direction from the region opposed to the scanning area of the recording head on the platen.

4. The inkjet recording apparatus according to claim 1, wherein the first recessed portion includes a bottom face, wherein the bottom face includes a suction port provided on an upstream side in a recording medium conveyance direction and is connected to the suction generating unit, and wherein a depth of the bottom face on a downstream side is smaller than that on the upstream side.

5. The inkjet recording apparatus according to claim 1, wherein the inkjet recording apparatus can perform borderless recording on the recording medium, and the platen includes an ink receiver adapted to receive ink discharged when the borderless recording is performed.

6. The inkjet apparatus according to claim 1, wherein the first recessed portion comprises a plurality of groves, and each of the plurality of grooves are generally rectangular shaped.

7. An inkjet recording apparatus comprising:

a platen for supporting a recording medium at a position opposed to a recording head;

a suction generating unit configured to provide suction that holds the recording medium to the platen;

a first recessed portion provided on the platen; and a second recessed portion provided on the platen, wherein the first recessed portion and the second recessed portion are connected to the suction generating unit, wherein the first recessed portion is provided at a position that occupies a recordable region of the recording head in a conveyance direction of the recording medium, wherein the first recessed portion does not have a portion that does not face the recording head, wherein the second recessed portion occupies an area positioned downstream of the recordable region of the recording head and is provided at a position corresponding to a side end portion of the recording medium to be conveyed, and wherein a recessed portion connected to the suction generating unit is not provided at a position forming a line in a conveyance direction of the recording medium of the first recessed portion except the second r recessed portion.

8. The inkjet apparatus according to claim 7, wherein a plurality of the second recessed portions are provided at positions corresponding to a side end portion of the recording medium of plural sizes.

9. An inkjet recording apparatus comprising:

a platen that supports a recording medium conveyed in a first direction; and a carriage that holds a recording head and reciprocates along a surface of the platen in a second direction which is perpendicular to the first direction, wherein the recording head has a nozzle array extending in the first direction;

wherein the platen has a first recessed portion provided on the platen and a second recessed portion provided on the platen being apart from the first recessed portion in the second direction, wherein suction is provided in each of the first recessed portion and the second recessed portion, wherein the first recessed portion has a length longer than that of the second recessed portion in the first direction, wherein the first recessed portion comprises a first part and a second part extending downstream of the first part, and the first part faces the entire of the nozzle array through the recording medium and the second part does not face the nozzle array when the nozzle array positions above the first recessed portion, and wherein the second recessed portion has a length that is the same of the first part in the first direction, and the second recessed portion faces the entire of the nozzle array through the recording medium when the nozzle array positions above the second recessed portion.

10. The inkjet recording apparatus according to claim 9, wherein the platen includes an ink receiver provided between the first recessed portion and the second recessed portion in the second direction, adapted to receive ink discharged when borderless recording is performed.

11. The inkjet apparatus according to claim 9, wherein the first recessed portion and the second recessed portion each has a grove of a rectangular shape.

* * * * *